US010820679B1

(12) United States Patent
Aossey

(10) Patent No.: US 10,820,679 B1
(45) Date of Patent: Nov. 3, 2020

(54) SELF HAIR-CUTTING DEVICE

(71) Applicant: Adam Yaseen Aossey, Powell, OH (US)

(72) Inventor: Adam Yaseen Aossey, Powell, OH (US)

( * ) Notice: Subject to any disclaimer, the term of this patent is extended or adjusted under 35 U.S.C. 154(b) by 461 days.

(21) Appl. No.: 15/783,001

(22) Filed: Oct. 13, 2017

Related U.S. Application Data

(60) Provisional application No. 62/412,333, filed on Oct. 25, 2016.

(51) Int. Cl.

| | |
|---|---|
| ***A45D 24/36*** | (2006.01) |
| ***B26B 19/04*** | (2006.01) |
| *B26B 29/06* | (2006.01) |
| *B26B 19/38* | (2006.01) |

(52) U.S. Cl.
CPC ..... *A45D 24/36* (2013.01); *B26B 19/04* (2013.01); *B26B 19/38* (2013.01); *B26B 29/06* (2013.01)

(58) Field of Classification Search
CPC ..... A45D 24/36; B26B 19/04; B26B 19/38; B26B 29/06
USPC ..... 132/214
See application file for complete search history.

(56) References Cited

U.S. PATENT DOCUMENTS 1,054,451 A * 2/1913 Sauer ..... A45D 24/36 132/214
1,091,372 A * 3/1914 Mickelson ..... A45D 24/36 132/214
1,247,787 A * 11/1917 Bridges ..... A45D 24/36 132/214
1,385,722 A 7/1921 Sessoms
1,589,037 A * 6/1926 Aasen ..... A45D 24/36 132/214
1,629,741 A 5/1927 Schick
2,766,761 A * 10/1956 Melfi ..... A45D 24/36 132/213.1
3,272,209 A * 9/1966 Kraus ..... A45D 24/36 132/213
3,407,823 A 10/1968 Selvaggio
4,137,925 A * 2/1979 Castillo ..... A45D 24/36 132/214
6,553,680 B2 * 4/2003 Vazdi ..... A45D 24/36 33/286
7,409,958 B1 * 8/2008 Vacker ..... A45D 24/36 132/214

(Continued)

*Primary Examiner* — Nicholas D Lucchesi
(74) *Attorney, Agent, or Firm* — The Law Office of Patrick F. O'Reilly III, LLC

(57) ABSTRACT

A self hair-cutting device is disclosed herein. The self hair-cutting device includes a pair of earpieces, the pair of earpieces configured to support the self hair-cutting device from the ears of a user; a pair of side guide members, each of the pair of side guide members coupled to a respective one of the pair of earpieces, and each of the pair of side guide members configured to form a side cutting guide for trimming a side hair line on opposed sides of the neck of the user; and at least one bottom guide member coupled to the pair of side guide members, the at least one bottom guide member configured to form a lower cutting guide for trimming a rear hair line of the user. One or more components of the self hair-cutting device are adjustable relative to one another to accommodate varying head geometries of different users.

20 Claims, 6 Drawing Sheets

(56) References Cited

U.S. PATENT DOCUMENTS

| | | | | |
|---|---|---|---|---|
| 8,826,922 | B1 * | 9/2014 | Lewis | A45D 24/36 132/213 |
| 9,778,631 | B2 * | 10/2017 | Krenik | G05B 15/02 |
| 9,993,058 | B2 * | 6/2018 | Krenik | A45D 24/36 |
| 2004/0074511 | A1 | 4/2004 | Sussan | |
| 2010/0275752 | A1 | 11/2010 | Ciccarelli | |
| 2014/0298964 | A1 | 10/2014 | Eisner | |
| 2015/0040934 | A1 * | 2/2015 | Krenik | A45D 24/36 132/200 |
| 2015/0265026 | A1 | 9/2015 | Yeheskel | |

* cited by examiner

SELF HAIR-CUTTING DEVICE

CROSS-REFERENCE TO RELATED APPLICATIONS

This patent application claims priority to, and incorporates by reference in its entirety, U.S. Provisional Patent Application No. 62/412,333, entitled "Self Hair-Cutting Device", filed on Oct. 25, 2016.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a self hair-cutting device. More particularly, the invention relates to a self hair-cutting device that includes a plurality of guide members for enabling an individual to more easily and accurately cut his or her own hair.

2. Background

Many people prefer to cut their own hair, rather than having a hair stylist or barber cut their hair for them. By cutting their own hair, these individuals are able to personally control the quality of the haircut that they receive. Also, particularly for individuals who want to cut their hair on a frequent basis, the cost savings associated with the cutting of their own hair can be significant. However, these individuals have no way of personally cutting the hair on the back of their own neck in a desirable shape because this area is not visible on one's own body.

Therefore, what is needed is a self hair-cutting device that will act as a guide to allow the user to trim his or her own hair at the back of the head in a consistent line. Moreover, a self hair-cutting device is needed that is intended to be used at the back of the neck, in the areas that are not visible to the user. Furthermore, there is a need for a self hair-cutting device that is readily adjustable to each user's individual anatomy.

BRIEF SUMMARY OF EMBODIMENTS OF THE INVENTION

Accordingly, the present invention is directed to a self hair-cutting device that substantially obviates one or more problems resulting from the limitations and deficiencies of the related art.

In accordance with one or more embodiments of the present invention, there is provided a self hair-cutting device, which includes a pair of earpieces, the pair of earpieces configured to support the self hair-cutting device from the ears of a user; a pair of side guide members, each of the pair of side guide members coupled to a respective one of the pair of earpieces, and each of the pair of side guide members configured to form a side cutting guide for trimming a side hair line on opposed sides of the neck of the user; and at least one bottom guide member coupled to the pair of side guide members, the at least one bottom guide member configured to form a lower cutting guide for trimming a rear hair line of the user. In these one or more embodiments, at least one of the pair of earpieces is adjustable relative to at least one of the pair of side guide members and/or at least one of the pair of side guide members is adjustable relative to the at least one bottom guide member so as to enable the self hair-cutting device to accommodate varying head geometries of different users.

In a further embodiment of the present invention, each of the pair of earpieces comprises a curved body portion having a first end and a second end disposed opposite to the first end, the first end of the curved body portion configured to be positioned on an anterior side of an ear of the user and the second end configured to be positioned on a posterior side of the ear of the user.

In yet a further embodiment, the curved body portion of each of the pair of earpieces comprises an aperture at the second end for receiving an upper end portion of a respective one of the pair of side guide members.

In still a further embodiment, the aperture at the second end of the curved body portion of at least one of the pair of earpieces is bounded by a ribbed wall; and wherein the upper end portion of at least one of the pair of side guide members comprises a plurality of longitudinally spaced-apart ribs disposed thereon configured to adjustably engage with the ribbed wall bounding the aperture of the curved body portion of the at least one of the pair of earpieces in a friction-fit type engagement.

In yet a further embodiment, the pair of side guide members are longitudinally adjustable relative to the pair of earpieces so as to enable a height of the at least one bottom guide member to be selected by the user, thereby enabling the user to selectively determine the elevation of the rear hair line.

In still a further embodiment, the pair of side guide members are rotatably adjustable relative to the pair of earpieces so as to enable the user to set the position of the self hair-cutting device for trimming the side hair lines on opposed sides of the neck of the user.

In yet a further embodiment, at least one of the pair of side guide members comprises an upper post portion and a lower comb portion disposed beneath the upper post portion, the upper post portion configured to engage a respective one of the pair of earpieces, and the lower comb portion including a plurality of spaced-apart teeth configured to allow the hair of the user to pass therebetween.

In still a further embodiment, the pair of side guide members are rotatably adjustable relative to the at least one bottom guide member so as to enable the self hair-cutting device to accommodate different head shapes of various users.

In yet a further embodiment, at least one of the pair of side guide members is rotatably coupled to the at least one bottom guide member by a ball and socket joint so as to enable the rotatable adjustment of the at least one of the pair of side guide members relative to the at least one bottom guide member.

In still a further embodiment, the ball and socket joint comprises a ball portion disposed on the at least one of the pair of side guide members and a socket portion disposed on the at least one bottom guide member.

In yet a further embodiment, the at least one bottom guide member comprises a first bottom guide member and a second bottom guide member, the first bottom guide member being adjustably coupled to the second bottom guide member so as to enable an overall spanning width of the first and second bottom guide members to be adjusted to accommodate varying head widths of the different users.

In still a further embodiment, at least one of the first bottom guide member and the second bottom guide member comprises an upper grip portion and a lower comb portion disposed beneath the upper grip portion, the upper grip portion configured to facilitate a grasping of the at least one of the first bottom guide member and the second bottom guide member by the user during the adjustment of the overall spanning width of the first and second bottom guide members, and the lower comb portion including a plurality of spaced-apart teeth configured to allow the hair of the user to pass therebetween.

In yet a further embodiment, one of the first bottom guide member and the second bottom guide member comprises a plurality of spaced-apart connecting protrusions disposed along a length thereof, and the other of the first bottom guide member and the second bottom guide member comprises a plurality of spaced-apart apertures disposed along a length thereof, the plurality of spaced-apart connecting protrusions being spaced apart at increments corresponding to the incremental spacing between the plurality of spaced-apart apertures so as to allow the user to adjust the overall spanning width of the first and second bottom guide members by selectively engaging selected ones of the spaced-apart connecting protrusions with corresponding selected ones of the plurality of spaced-apart apertures.

In accordance with one or more other embodiments of the present invention, there is provided a self hair-cutting device, which includes a pair of earpieces, the pair of earpieces configured to support the self hair-cutting device from the ears of a user; a pair of side guide members, each of the pair of side guide members coupled to a respective one of the pair of earpieces, and each of the pair of side guide members configured to form a side cutting guide for trimming a side hair line on opposed sides of the neck of the user; and a plurality of bottom guide members coupled to the pair of side guide members, the plurality of bottom guide members configured to form a lower cutting guide for trimming a rear hair line of the user. In these one or more embodiments, at least one of the pair of earpieces is adjustable relative to at least one of the pair of side guide members and/or at least one of the pair of side guide members is adjustable relative to the plurality of bottom guide members so as to enable the self hair-cutting device to accommodate varying head geometries of different users.

In a further embodiment of the present invention, each of the pair of earpieces comprises a curved body portion having a first end and a second end disposed opposite to the first end, the first end of the curved body portion configured to be positioned on an anterior side of an ear of the user and the second end configured to be positioned on a posterior side of the ear of the user.

In yet a further embodiment, the curved body portion of each of the pair of earpieces comprises an aperture at the second end for receiving an upper end portion of a respective one of the pair of side guide members.

In still a further embodiment, the aperture at the second end of the curved body portion of at least one of the pair of earpieces is bounded by a ribbed wall; and wherein the upper end portion of at least one of the pair of side guide members comprises a plurality of longitudinally spaced-apart ribs disposed thereon configured to adjustably engage with the ribbed wall bounding the aperture of the curved body portion of the at least one of the pair of earpieces in a friction-fit type engagement.

In yet a further embodiment, the pair of side guide members are longitudinally adjustable relative to the pair of earpieces so as to enable a height of the plurality of bottom guide members to be selected by the user, thereby enabling the user to selectively determine the elevation of the rear hair line.

In still a further embodiment, the pair of side guide members are rotatably adjustable relative to the pair of earpieces so as to enable the user to set the position of the self hair-cutting device for trimming the side hair lines on opposed sides of the neck of the user.

In yet a further embodiment, at least one of the pair of side guide members comprises an upper post portion and a lower comb portion disposed beneath the upper post portion, the upper post portion configured to engage a respective one of the pair of earpieces, and the lower comb portion including a plurality of spaced-apart teeth configured to allow the hair of the user to pass therebetween.

In still a further embodiment, the pair of side guide members are rotatably adjustable relative to the plurality of bottom guide members so as to enable the self hair-cutting device to accommodate different head shapes of various users.

In yet a further embodiment, at least one of the pair of side guide members is rotatably coupled to one of the plurality of bottom guide members by a ball and socket joint so as to enable the rotatable adjustment of the at least one of the pair of side guide members relative to the one of the plurality of bottom guide members.

In still a further embodiment, the ball and socket joint comprises a ball portion disposed on the at least one of the pair of side guide members and a socket portion disposed on the one of the plurality of bottom guide members.

In yet a further embodiment, the plurality of bottom guide members comprises a first bottom guide member and a second bottom guide member, the first bottom guide member being adjustably coupled to the second bottom guide member so as to enable an overall spanning width of the first and second bottom guide members to be adjusted to accommodate varying head widths of the different users.

In still a further embodiment, at least one of the first bottom guide member and the second bottom guide member comprises an upper grip portion and a lower comb portion disposed beneath the upper grip portion, the upper grip portion configured to facilitate a grasping of the at least one of the first bottom guide member and the second bottom guide member by the user during the adjustment of the overall spanning width of the first and second bottom guide members, and the lower comb portion including a plurality of spaced-apart teeth configured to allow the hair of the user to pass therebetween.

In yet a further embodiment, one of the first bottom guide member and the second bottom guide member comprises a plurality of spaced-apart connecting protrusions disposed along a length thereof, and the other of the first bottom guide member and the second bottom guide member comprises a plurality of spaced-apart apertures disposed along a length thereof, the plurality of spaced-apart connecting protrusions being spaced apart at increments corresponding to the incremental spacing between the plurality of spaced-apart apertures so as to allow the user to adjust the overall spanning width of the first and second bottom guide members by selectively engaging selected ones of the spaced-apart connecting protrusions with corresponding selected ones of the plurality of spaced-apart apertures.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
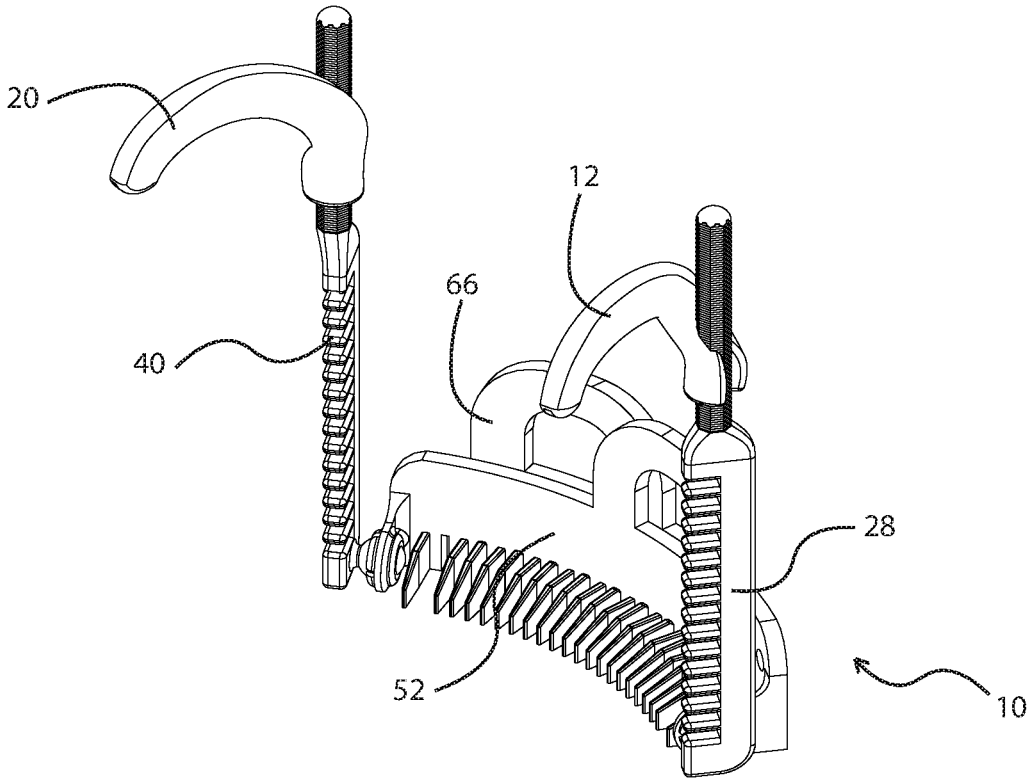
FIG. 1 is a frontal perspective view of a self hair-cutting device, according to an embodiment of the invention.
Figure 2:
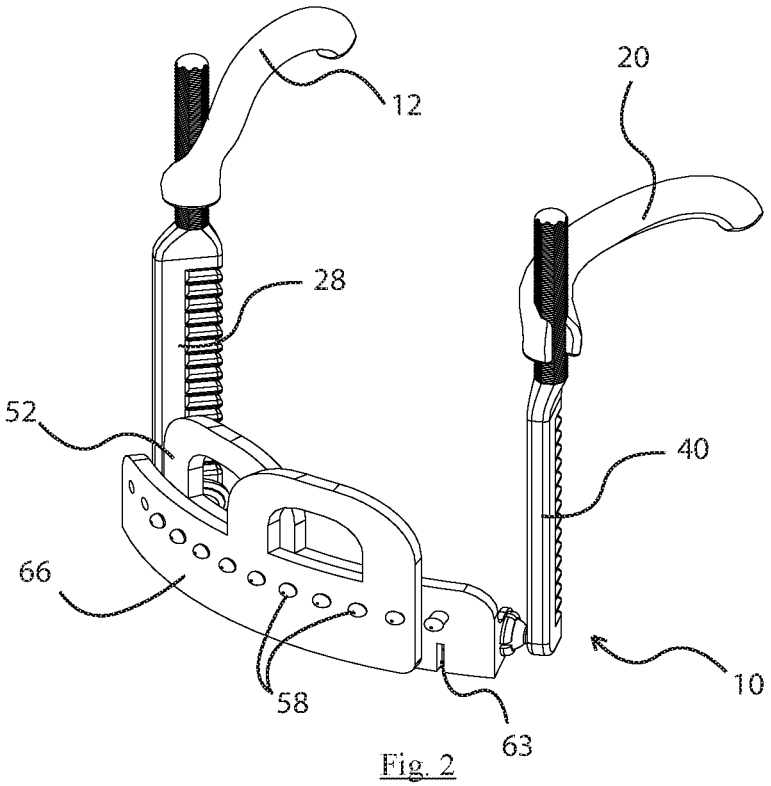
FIG. 2 is a rear perspective view of the self hair-cutting device of FIG. 1.
Figure 9:
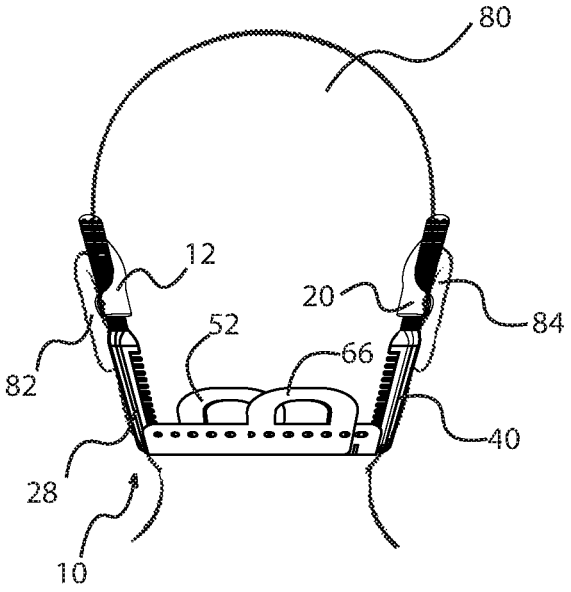
FIG. 9 is a rear elevational view of the self hair-cutting device of FIG. 1 shown disposed on the head of a person.
Figure 10:
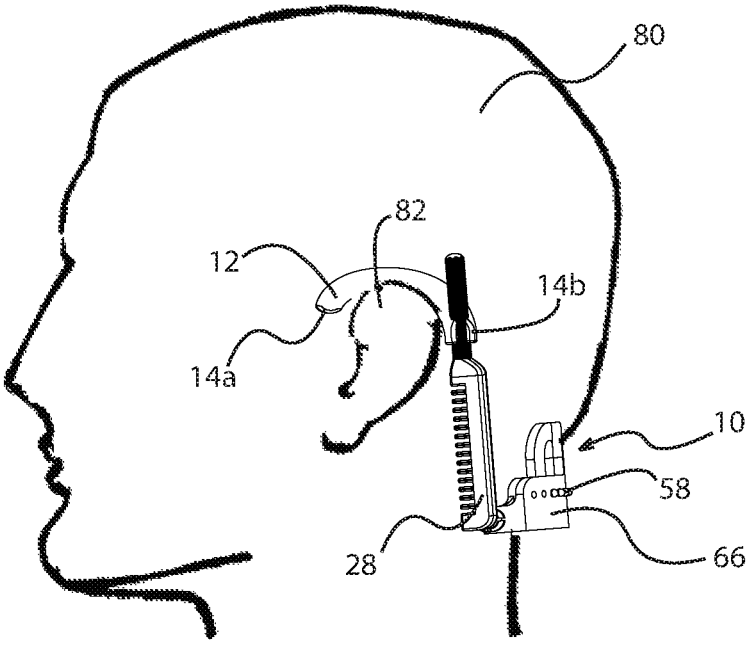
FIG. 10 is a side elevational view of the self hair-cutting device of FIG. 1 shown disposed on the head of the person.
Figure 11:
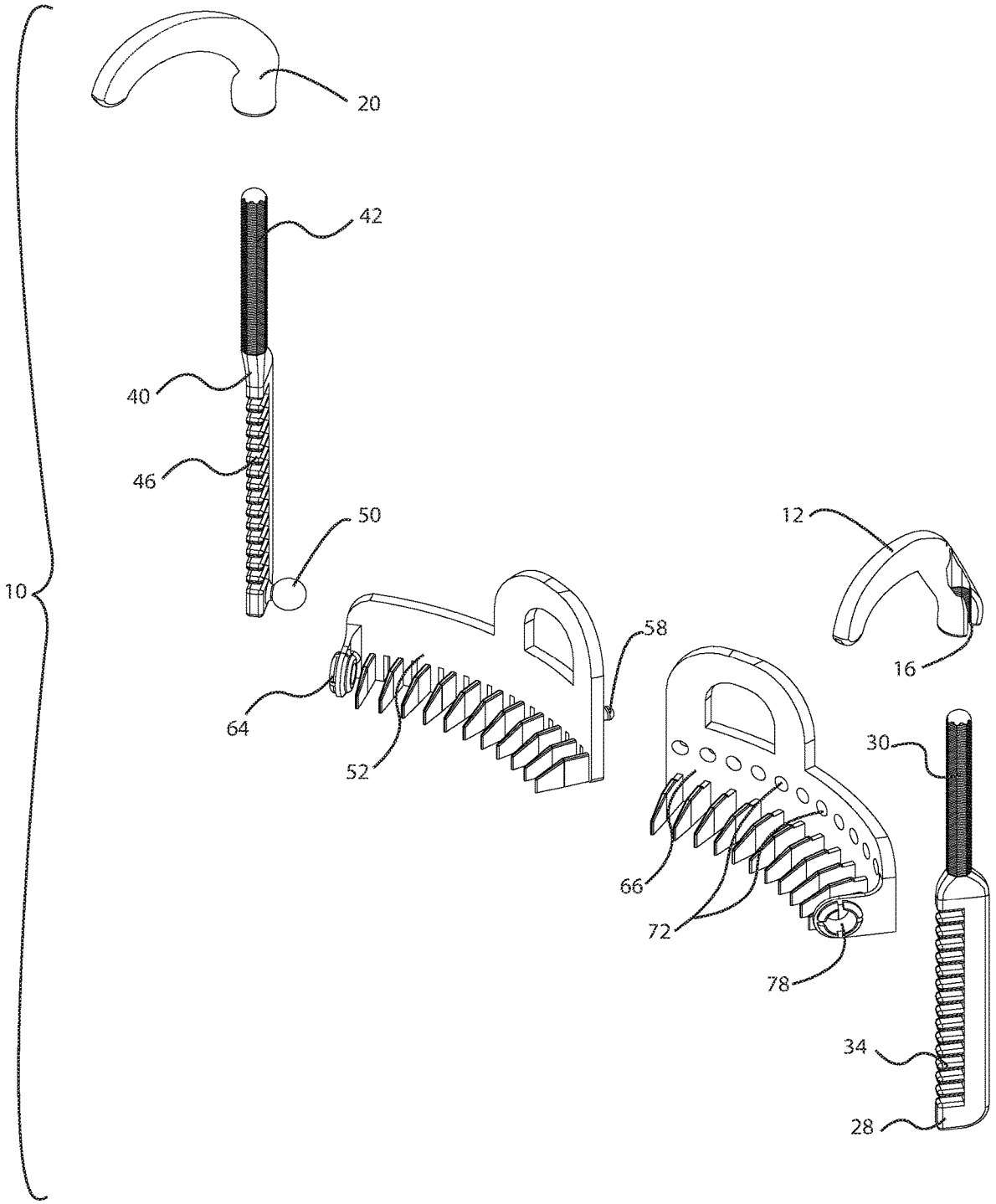
FIG. 11 is an exploded perspective view of the self hair-cutting device of FIG. 1.

An illustrative embodiment of a self hair-cutting device is seen generally at 10 in FIGS. 1, 2, and 11. The illustrated self hair-cutting device is particularly useful for acting as a guide to allow the user to trim his or her own hair at the back of the head in a consistent line. With reference initially to FIGS. 1 and 2, it can be seen that the self hair-cutting device 10 generally comprises a pair of earpieces 12, 20, the pair of earpieces 12, 20 configured to support the self hair-cutting device 10 from the ears 82, 84 of the head 80 of a user (see e.g., FIGS. 9 and 10); a pair of side guide members 28, 40, each of the pair of side guide members 28, 40 coupled to a respective one of the pair of earpieces 12, 20, and each of the pair of side guide members 28, 40 configured to form a side cutting guide for trimming a side hair line on opposed sides of the neck of the user; and a plurality of bottom guide members 52, 66 coupled to the pair of side guide members 28, 40, the plurality of bottom guide members 52, 66 configured to form a lower cutting guide for trimming a rear hair line of the user. As will be explained in detail hereinafter, in the illustrated embodiment of FIGS. 1 and 2, the earpieces 12, 20 are adjustable relative to the side guide members 28, 40, and the side guide members 28, 40 are adjustable relative to the bottom guide members 52, 66 so as to enable the self hair-cutting device 10 to accommodate varying head geometries of different users. As shown in FIGS. 9 and 10, the self hair-cutting device 10 attaches to the user's ears 82, 84, which serve as datum points for the device 10.

Figure 5:
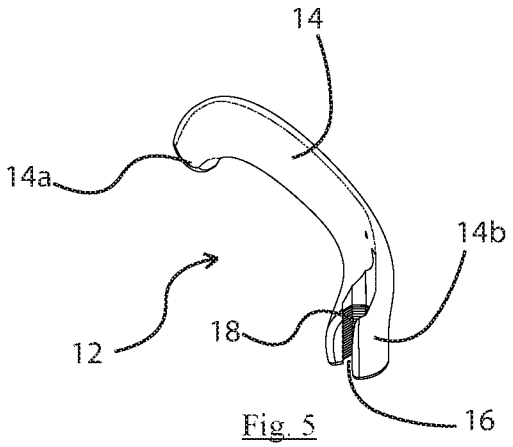
FIG. 5 is a side perspective view of a first earpiece of the self hair-cutting device of FIG. 1.

Now, referring particularly to FIGS. 5 and 7, the first and second earpieces 12, 20 of the illustrative self hair-cutting device 10 will be described. Initially, as shown in FIG. 5, it can be seen that the first earpiece 12 comprises a curved body portion 14 having a first end 14*a* and a second end 14*b* disposed opposite to the first end 14*a*. As shown in FIG. 10, the first end 14*a* of the curved body portion 14 is configured to be positioned on an anterior side of an ear 82 of the user 80 (e.g., a left ear of the user) and the second end 14*b* is configured to be positioned on a posterior side of the ear 82 of the user 80. The curved body portion 14 of the first earpiece 12 comprises an aperture 16 at the second end 14*b* for receiving an upper end portion (i.e., a longitudinal section of upper post portion 30) of the first side guide member 28 (see FIG. 5). The aperture 16 at the second end 14*b* of the curved body portion 14 of the first earpiece 12 is bounded by a ribbed wall 18 (i.e., the interior wall 18 of the aperture 16 is provided with a plurality of longitudinally spaced-apart circumferential ribs disposed thereon). As shown in FIG. 8, the upper end portion of the first side guide member 28 comprises a plurality of longitudinally spaced-apart circumferential ribs disposed thereon configured to adjustably engage with the ribbed interior wall 18 bounding the aperture 16 of the curved body portion 14 of the first earpiece 12 in a friction-fit type engagement (the ribs of the earpiece 12 and first side guide member 28 matingly engage with one another in an adjustable manner).

Figure 6:
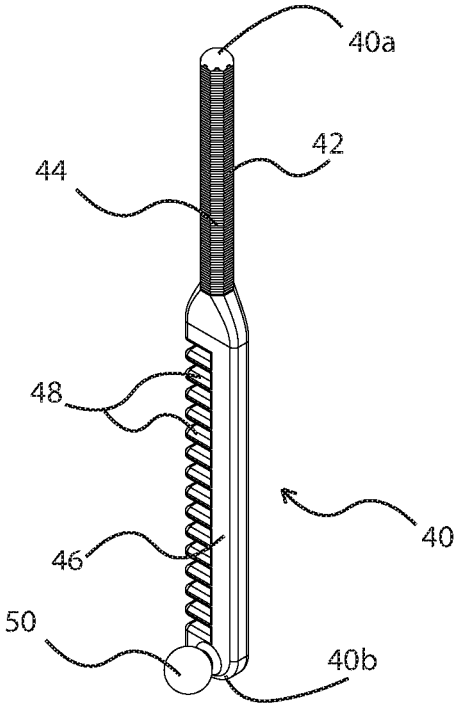
FIG. 6 is a side perspective view of a second side guide member of the self hair-cutting device of FIG. 1.
Figure 7:
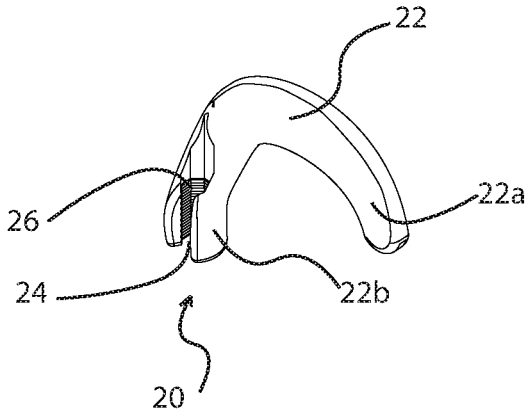
FIG. 7 is a side perspective view of a second earpiece of the self hair-cutting device of FIG. 1.
Figure 8:
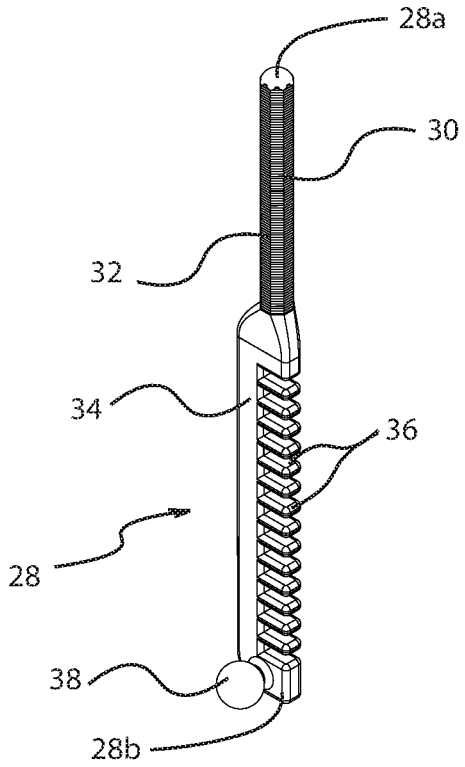
FIG. 8 is a side perspective view of a first side guide member of the self hair-cutting device of FIG. 1.

Similarly, as shown in FIG. 7, it can be seen that the second earpiece 20, like the first earpiece 12, comprises a curved body portion 22 having a first end 22*a* and a second end 22*b* disposed opposite to the first end 22*a*. The first end 22*a* of the curved body portion 22 is configured to be positioned on an anterior side of an ear 84 of the user 80 (e.g., a right ear of the user) and the second end 22*b* is configured to be positioned on a posterior side of the ear 84 of the user 80 (see FIG. 9). The curved body portion 22 of the second earpiece 20 comprises an aperture 24 at the second end 22*b* for receiving an upper end portion (i.e., a longitudinal section of upper post portion 42) of the second side guide member 40 (see FIG. 6). Like the aperture 16 of the first earpiece 12, the aperture 24 at the second end 22*b* of the curved body portion 22 of the second earpiece 20 is bounded by a ribbed wall 26 (i.e., the interior wall 26 of the aperture 24 is provided with a plurality of longitudinally spaced-apart circumferential ribs disposed thereon). As shown in FIG. 6, the upper end portion of the second side guide member 40 comprises a plurality of longitudinally spaced-apart circumferential ribs disposed thereon configured to adjustably engage with the ribbed interior wall 26 bounding the aperture 24 of the curved body portion 22 of the second earpiece 20 in a friction-fit type engagement (the ribs of the earpiece 20 and second side guide member 40 matingly engage with one another in an adjustable manner).

Next, with particular reference to FIGS. 6 and 8, the first and second side guide members 28, 40 of the illustrative self hair-cutting device 10 will be explained. Initially, as shown in FIG. 8, it can be seen that the first side guide member 28 comprises an upper post portion 30 and a lower comb portion 34 disposed beneath the upper post portion 30. The cylindrical upper post portion 30 is configured to engage the first earpiece 12, and the lower comb portion 34 includes a plurality of longitudinally spaced-apart teeth 36 configured to allow the hair of the user 80 to pass therebetween (i.e., the hairs of the user pass through the slits between the guide teeth 36). As shown in FIG. 8, the upper post portion 30 of the first side guide member 28 comprises a ribbed outer wall 32 with a plurality of longitudinally spaced-apart circumferential ribs disposed along substantially an entire length thereof, which are configured to adjustably engage with the longitudinally spaced-apart circumferential ribs on the ribbed interior wall 18 bounding the aperture 16 of the curved body portion 14 of the first earpiece 12. In FIG. 8, it can be seen that the first side guide member 28 has a first end 28*a* at the upper end of the post portion 30 and a second, oppositely disposed end 28*b* at the lower end of the lower comb portion 34. As shown in FIG. 8, a ball portion 38 of a ball and socket joint, which will be described hereinafter, is provided at the second end 28*b* of the first side guide member 28.

Similarly, as shown in FIG. 6, it can be seen that the second side guide member 40, like the first side guide member 28, comprises an upper post portion 42 and a lower comb portion 46 disposed beneath the upper post portion 42. The cylindrical upper post portion 42 is configured to engage the second earpiece 20, and the lower comb portion 46 includes a plurality of longitudinally spaced-apart teeth 48 configured to allow the hair of the user 80 to pass therebetween (i.e., the hairs of the user pass through the slits between the guide teeth 48). As shown in FIG. 6, the upper post portion 42 of the second side guide member 40 comprises a ribbed outer wall 44 with a plurality of longitudinally spaced-apart circumferential ribs disposed along substantially an entire length thereof, which are configured to adjustably engage with the longitudinally spaced-apart circumferential ribs on the ribbed interior wall 26 bounding the aperture 24 of the curved body portion 22 of the second earpiece 20. In FIG. 6, it can be seen that the second side guide member 40 has a first end 40*a* at the upper end of the post portion 42 and a second, oppositely disposed end 40*b* at the lower end of the lower comb portion 46. As shown in FIG. 6, a ball portion 50 of a ball and socket joint, which will be described hereinafter, is provided at the second end 40*b* of the second side guide member 40.

Referring again to FIGS. 1, 2, 9, and 10, the first side guide member 28 is longitudinally adjustable relative to the first earpiece 12, and the second side guide member 40 is longitudinally adjustable relative to the second earpiece 20, so as to enable a height of the first and second bottom guide members 52, 66 to be selected by the user 80, thereby enabling the user 80 to selectively determine the elevation of the rear hair line. Also, with reference to FIGS. 1, 2, 9, and 10, the first side guide member 28 is rotatably adjustable relative to the first earpiece 12, and the second side guide member 40 is rotatably adjustable relative to the second earpiece 20, so as to enable the user to set the position of the self hair-cutting device 10 for trimming the side hair lines on opposed sides of the neck of the user 80. In the illustrative embodiment, the first and second side guide members 28, 40 may be rotatably adjustable in a step-type manner with respect to the respective first and second earpieces 12, 20 (i.e., when the upper post portions 30, 42 of the first and second side guide members 28, 40 have a polygonal cross-section, such as an octagonal cross-section, and the apertures 16, 24 of the first and second earpieces 12, 20 have a corresponding polygonal cross-section, such as an octagonal cross-section, the rotational adjustment is step-type rotation).

Also, in the illustrative embodiment, the first and second side guide members 28, 40 are each rotatably adjustable relative to the first and second bottom guide members 52, 66 so as to enable the self hair-cutting device 10 to accommodate different head shapes of various users (see FIGS. 1 and 2). In particular, referring to FIGS. 1, 2, and 11, the first side guide member 28 is rotatably coupled to the second bottom guide member 66 by a first ball and socket joint, and the second side guide member 40 is rotatably coupled to the first bottom guide member 52 by a second ball and socket joint, so as to enable the rotatable adjustment of the first and second side guide members 28, 40 relative to the first and second bottom guide members 52, 66. The first ball and socket joint comprises a ball portion 38 disposed on the first side guide member 28 and a socket portion 78 disposed on the second bottom guide member 66. The second ball and socket joint comprises a ball portion 50 disposed on the second side guide member 40 and a socket portion 64 disposed on the first bottom guide member 52. Advantageously, the first and second ball and socket joints each enable three degrees of freedom in order to enable the self hair-cutting device 10 to readily fit a multitude of different head shapes.

Figure 3:
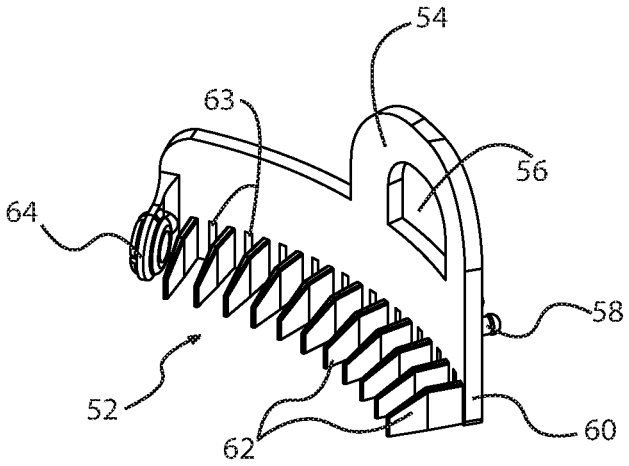
FIG. 3 is a frontal perspective view of a first bottom guide member of the self hair-cutting device of FIG. 1.

Now, referring primarily to FIGS. 3 and 4, the first and second bottom guide members 52, 66 of the illustrative self hair-cutting device 10 will be described. As will be explained hereinafter, the first bottom guide member 52 is adjustably coupled to the second bottom guide member 66 so as to enable an overall spanning width of the first and second bottom guide members 52, 66 to be adjusted to accommodate varying head widths of different users. Initially, as shown in FIG. 3, it can be seen that the first bottom guide member 52 comprises an upper grip portion 54 and a lower comb portion 60 disposed beneath the upper grip portion 54. The upper grip portion 54 with aperture 56 is configured to facilitate a grasping of the first bottom guide member 52 by the user 80 during the adjustment of the overall spanning width of the first and second bottom guide members 52, 66. In FIG. 3, it can be seen that the lower comb portion 60 includes a plurality of spaced-apart teeth 62 configured to allow the hair of the user to pass therebetween (i.e., the hairs of the user pass through the hair slits 63 between the guide teeth 62). Also, with reference again to FIG. 3, it can be seen that the first bottom guide member 52 comprises a plurality of spaced-apart connecting protrusions 58 disposed along a length thereof. The plurality of spaced-apart connecting protrusions 58 are spaced apart at increments corresponding to the incremental spacing between a plurality of spaced-apart apertures 72 on the second bottom guide member 66 (see FIG. 4) so as to allow the user 80 to adjust the overall spanning width of the first and second bottom guide members 52, 66 by selectively engaging selected ones of the spaced-apart connecting protrusions 58 with corresponding selected ones of the plurality of spaced-apart apertures 72.

Figure 4:
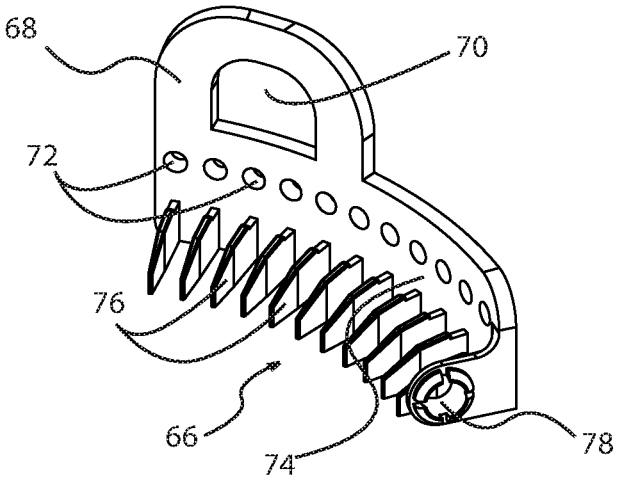
FIG. 4 is a frontal perspective view of a second bottom guide member of the self hair-cutting device of FIG. 1.

Similarly, as shown in FIG. 4, it can be seen that the second bottom guide member 66, like the first bottom guide member 52, comprises an upper grip portion 68 and a lower comb portion 74 disposed beneath the upper grip portion 68. The upper grip portion 68 with aperture 70 is configured to facilitate a grasping of the second bottom guide member 66 by the user 80 during the adjustment of the overall spanning width of the first and second bottom guide members 52, 66. In FIG. 4, it can be seen that the lower comb portion 74 includes a plurality of spaced-apart teeth 76 configured to allow the hair of the user to pass therebetween (i.e., the hairs of the user pass through the hair slits between the guide teeth 76). Also, with reference again to FIG. 4, it can be seen that the second bottom guide member 66 comprises a plurality of spaced-apart apertures 72 disposed along a length thereof. The plurality of spaced-apart apertures 72 are spaced apart at increments corresponding to the incremental spacing between the plurality of spaced-apart connecting protrusions 58 on the first bottom guide member 52 (see FIG. 3) so as to allow the user 80 to adjust the overall spanning width of the first and second bottom guide members 52, 66 by selectively engaging selected ones of the spaced-apart connecting protrusions 58 with corresponding selected ones of the plurality of spaced-apart apertures 72.

In an exemplary embodiment, the constituent components 12, 20, 28, 40, 52, 66 of the self hair-cutting device 10 may be formed from a suitable polymeric material or plastic. Preferably, in the exemplary embodiment, the polymeric material or plastic is durable and lightweight.

It is readily apparent that the aforedescribed self hair-cutting device 10 offers numerous advantages. First, the self hair-cutting device 10 described herein acts as a guide to allow the user to trim his or her own hair at the back of the head in a consistent line. Secondly, the aforedescribed self hair-cutting device 10 is capable of being effectively used at the back of the neck, in the areas that are not visible to the user. Finally, the self hair-cutting device 10 described herein is readily adjustable to each user's individual anatomy.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A self hair-cutting device, comprising:

a pair of earpieces, said pair of earpieces configured to support said self hair-cutting device from the ears of a user;

a pair of side guide members, each of said pair of side guide members coupled to a respective one of said pair of earpieces, and each of said pair of side guide members configured to form a side cutting guide for trimming a side hair line on opposed sides of the neck of said user; and at least one bottom guide member coupled to said pair of side guide members, said at least one bottom guide member configured to form a lower cutting guide for trimming a rear hair line of said user;

wherein at least one of said pair of earpieces is adjustable relative to at least one of said pair of side guide members and/or at least one of said pair of side guide members is adjustable relative to said at least one bottom guide member so as to enable said self hair-cutting device to accommodate varying head geometries of different users.

2. The self hair-cutting device according to claim 1, wherein each of said pair of earpieces comprises a curved body portion having a first end and a second end disposed opposite to said first end, said first end of said curved body portion configured to be positioned on an anterior side of an ear of said user and said second end configured to be positioned on a posterior side of said ear of said user, said curved body portion of each of said pair of earpieces further comprising an aperture at said second end for receiving an upper end portion of a respective one of said pair of side guide members.

3. The self hair-cutting device according to claim 2, wherein said aperture at said second end of said curved body portion of at least one of said pair of earpieces is bounded by a ribbed wall; and wherein said upper end portion of at least one of said pair of side guide members comprises a plurality of longitudinally spaced-apart ribs disposed thereon configured to adjustably engage with said ribbed wall bounding said aperture of said curved body portion of said at least one of said pair of earpieces in a friction-fit type engagement.

4. The self hair-cutting device according to claim 1, wherein said pair of side guide members are longitudinally adjustable relative to said pair of earpieces so as to enable a height of said at least one bottom guide member to be selected by said user, thereby enabling said user to selectively determine the elevation of said rear hair line.

5. The self hair-cutting device according to claim 1, wherein said pair of side guide members are rotatably adjustable relative to said pair of earpieces so as to enable said user to set the position of said self hair-cutting device for trimming said side hair lines on opposed sides of said neck of said user.

6. The self hair-cutting device according to claim 1, wherein at least one of said pair of side guide members comprises an upper post portion and a lower comb portion disposed beneath said upper post portion, said upper post portion configured to engage a respective one of said pair of earpieces, and said lower comb portion including a plurality of spaced-apart teeth configured to allow the hair of said user to pass therebetween.

7. The self hair-cutting device according to claim 1, wherein said pair of side guide members are rotatably adjustable relative to said at least one bottom guide member so as to enable said self hair-cutting device to accommodate different head shapes of various users.

8. The self hair-cutting device according to claim 7, wherein at least one of said pair of side guide members is rotatably coupled to said at least one bottom guide member by a ball and socket joint so as to enable rotatable adjustment of said at least one of said pair of side guide members relative to said at least one bottom guide member for accommodating different head shapes of various users, said ball and socket joint comprising a ball portion disposed on said at least one of said pair of side guide members and a socket portion disposed on said at least one bottom guide member.

9. The self hair-cutting device according to claim 1, wherein said at least one bottom guide member comprises a first bottom guide member and a second bottom guide member, said first bottom guide member being adjustably coupled to said second bottom guide member so as to enable an overall spanning width of said first and second bottom guide members to be adjusted to accommodate varying head widths of said different users.

10. The self hair-cutting device according to claim 9, wherein at least one of said first bottom guide member and said second bottom guide member comprises an upper grip portion and a lower comb portion disposed beneath said upper grip portion, said upper grip portion configured to facilitate a grasping of said at least one of said first bottom guide member and said second bottom guide member by said user during the adjustment of said overall spanning width of said first and second bottom guide members, and said lower comb portion including a plurality of spaced-apart teeth configured to allow the hair of said user to pass therebetween.

11. The self hair-cutting device according to claim 9, wherein one of said first bottom guide member and said second bottom guide member comprises a plurality of spaced-apart connecting protrusions disposed along a length thereof, and the other of said first bottom guide member and said second bottom guide member comprises a plurality of spaced-apart apertures disposed along a length thereof, said plurality of spaced-apart connecting protrusions being spaced apart at increments corresponding to the incremental spacing between said plurality of spaced-apart apertures so as to allow said user to adjust said overall spanning width of said first and second bottom guide members by selectively engaging selected ones of said spaced-apart connecting protrusions with corresponding selected ones of said plurality of spaced-apart apertures.

12. A self hair-cutting device, comprising:

a pair of earpieces, said pair of earpieces configured to support said self hair-cutting device from the ears of a user;

a pair of side guide members, each of said pair of side guide members coupled to a respective one of said pair of earpieces, and each of said pair of side guide members configured to form a side cutting guide for trimming a side hair line on opposed sides of the neck of said user; and a plurality of bottom guide members coupled to said pair of side guide members, said plurality of bottom guide members configured to form a lower cutting guide for trimming a rear hair line of said user;

wherein at least one of said pair of earpieces is adjustable relative to at least one of said pair of side guide members and/or at least one of said pair of side guide members is adjustable relative to said plurality of bottom guide members so as to enable said self hair-cutting device to accommodate varying head geometries of different users.

13. The self hair-cutting device according to claim 12, wherein each of said pair of earpieces comprises a curved body portion having a first end and a second end disposed opposite to said first end, said first end of said curved body portion configured to be positioned on an anterior side of an ear of said user and said second end configured to be positioned on a posterior side of said ear of said user, said curved body portion of each of said pair of earpieces further comprising an aperture at said second end for receiving an upper end portion of a respective one of said pair of side guide members.

14. The self hair-cutting device according to claim 13, wherein said aperture at said second end of said curved body portion of at least one of said pair of earpieces is bounded by a ribbed wall; and wherein said upper end portion of at least one of said pair of side guide members comprises a plurality of longitudinally spaced-apart ribs disposed thereon configured to adjustably engage with said ribbed wall bounding said aperture of said curved body portion of said at least one of said pair of earpieces in a friction-fit type engagement.

15. The self hair-cutting device according to claim 12, wherein said pair of side guide members are longitudinally adjustable relative to said pair of earpieces so as to enable a height of said plurality of bottom guide members to be selected by said user, thereby enabling said user to selectively determine the elevation of said rear hair line, and wherein said pair of side guide members are further rotatably adjustable relative to said pair of earpieces so as to enable said user to set the position of said self hair-cutting device for trimming said side hair lines on opposed sides of said neck of said user.

16. The self hair-cutting device according to claim 12, wherein at least one of said pair of side guide members comprises an upper post portion and a lower comb portion disposed beneath said upper post portion, said upper post portion configured to engage a respective one of said pair of earpieces, and said lower comb portion including a plurality of spaced-apart teeth configured to allow the hair of said user to pass therebetween.

17. The self hair-cutting device according to claim 12, wherein at least one of said pair of side guide members is rotatably coupled to one of said plurality of bottom guide members by a ball and socket joint so as to enable rotatable adjustment of said at least one of said pair of side guide members relative to said one of said plurality of bottom guide members for accommodating different head shapes of various users, said ball and socket joint comprising a ball portion disposed on said at least one of said pair of side guide members and a socket portion disposed on said one of said plurality of bottom guide members.

18. The self hair-cutting device according to claim 12, wherein said plurality of bottom guide members comprises a first bottom guide member and a second bottom guide member, said first bottom guide member being adjustably coupled to said second bottom guide member so as to enable an overall spanning width of said first and second bottom guide members to be adjusted to accommodate varying head widths of said different users.

19. The self hair-cutting device according to claim 18, wherein at least one of said first bottom guide member and said second bottom guide member comprises an upper grip portion and a lower comb portion disposed beneath said upper grip portion, said upper grip portion configured to facilitate a grasping of said at least one of said first bottom guide member and said second bottom guide member by said user during the adjustment of said overall spanning width of said first and second bottom guide members, and said lower comb portion including a plurality of spaced-apart teeth configured to allow the hair of said user to pass therebetween.

20. The self hair-cutting device according to claim 18, wherein one of said first bottom guide member and said second bottom guide member comprises a plurality of spaced-apart connecting protrusions disposed along a length thereof, and the other of said first bottom guide member and said second bottom guide member comprises a plurality of spaced-apart apertures disposed along a length thereof, said plurality of spaced-apart connecting protrusions being spaced apart at increments corresponding to the incremental spacing between said plurality of spaced-apart apertures so as to allow said user to adjust said overall spanning width of said first and second bottom guide members by selectively engaging selected ones of said spaced-apart connecting protrusions with corresponding selected ones of said plurality of spaced-apart apertures.

* * * * *